United States Patent [19]

Beuther et al.

[11] 4,090,942

[45] May 23, 1978

[54] PROCESS FOR PRODUCING BENZENE

[75] Inventors: Harold Beuther, Gibsonia; Angelo A. Montagna, Monroeville, both of Pa.

[73] Assignee: Gulf Research & Development Company, Pittsburgh, Pa.

[21] Appl. No.: 736,841

[22] Filed: Oct. 29, 1976

Related U.S. Application Data

[63] Continuation-in-part of Ser. No. 688,106, May 19, 1976, abandoned.

[51] Int. Cl.[2] ..... C10G 1/00

[52] U.S. Cl. ..... 208/8; 208/107; 260/668 R; 260/668 D; 260/668 F

[58] Field of Search ..... 260/668 R, 668 D, 668 F; 208/8, 107

[56] References Cited

U.S. PATENT DOCUMENTS

| | | | |
|---|---|---|---|
| 2,381,522 | 8/1945 | Stewart | 260/668 R |
| 2,388,937 | 11/1945 | Schmerling et al. | 260/668 R |
| 2,875,150 | 2/1959 | Schuman | 208/147 |
| 2,885,337 | 5/1959 | Keith et al. | 208/107 |
| 3,030,297 | 4/1962 | Schroeder | 208/8 |
| 3,178,272 | 4/1965 | Deut et al. | 208/59 |
| 3,210,432 | 10/1965 | Richter | 260/668 R |

*Primary Examiner*—Veronica O'Keefe

[57] ABSTRACT

A process for preparing benzene which involves heating a hydrocarbon stock containing polynuclear aromatic rings and having critical hydrogen to carbon atomic ratios in the presence of hydrogen under critical reaction conditions.

2 Claims, No Drawings

PROCESS FOR PRODUCING BENZENE

This application is a continuation-in-part application of our U.S. Patent Application Ser. No. 688,106, filed May 19, 1976 now abandoned, entitled Process for Producing Benzene.

BACKGROUND OF THE INVENTION

1. Field of the Invention

This invention relates to a process for converting a hydrocarbon stock containing substantial amounts of polynuclear aromatic rings to a product containing significant amounts of benzene.

2. Description of the Prior Art

Hydrocarbon stocks have been subjected to treatment at elevated temperatures in the presence of hydrogen to obtain lower-molecular weight hydrocarbons, but the reactions described have not resulted in the production of reaction products containing substantial amounts of benzene. Such processes are described in U.S. Pat. Nos. 2,875,150 to Schuman, 2,885,337 to Keith et al and 3,178,272 to Dent et al. In our U.S. Application Ser. No. 688,106, filed May 19, 1976, we have prepared benzene by heating a hydrocarbon stock containing polynuclear aromatic rings in the presence of hydrogen under critical reaction conditions.

SUMMARY OF THE INVENTION

We have now found that we can obtain increased amounts of benzene over the amounts we have obtained in our process defined and claimed in our U.S. Application Ser. No. 688,106, provided the hydrocarbon charge used therein additionally has critical hydrogen to carbon atomic ratios.

The hydrocarbon charge stock used herein is one boiling above about 200° C. at atmospheric pressure of coal origin or from other sources, such as petroleum, oil shale or tar sands, containing at least about 30 weight per cent aromatics, of which at least about 40 weight per cent are polynuclear aromatic compounds, condensed (fused) as well as non-condensed. Examples of such hydrocarbon charge stocks are coal liquids derived from the hydrogenation of coal, FCC Furnace Oil, FCC Decanted Oils, tar sand bitumen, oil from shale rock, atmospheric tower bottoms, vacuum tower bottoms, etc. As pointed out above, in order to obtain increased amounts of benzene the ratios of hydrogen to carbon in the hydrocarbon feed are critical. We have found that when the atomic ratio of hydrogen to carbon is in the range of about 0.8:1 to about 1.05:1, preferably about 0.85:1 to about 1:1, increased benzene yields will be obtained.

The process is simply carried out by heating the hydrocarbon charge defined above in the presence of hydrogen, preferably by passing the mixture through a non-catalytic bed composed, for example, of particulate material, such as bauxite, sand, zircon, quartz, magnesia, alumina, magnesia-alumina, silica-alumina, etc. However, the conditions needed to convert the defined charge to a product containing substantial amounts of benzene are critical.

The average temperature in the reaction zone must be within the range of about 650° to about 1100° C., preferably within the range of about 700° to about 930° C. By "average temperature" we mean the volume average temperature of the fraction of the reactor which is above 650° C. In addition, it is necessary that the temperature in the reaction zone reach a minimum level of 700° C., preferably about 760° C. The total pressure in the reaction zone must be between about 800 to about 2500 pounds per square inch gauge (about 56 to about 175 kilograms per square centimeter), preferably in the range of about 900 to about 2000 pounds per square inch gauge (about 63 to about 140 kilograms per square centimeter). The hydrogen partial pressure must be within the range of about 500 to about 2000 pounds per square inch gauge (about 35 to about 140 kilograms per square centimeter), preferably about 800 to about 1600 pounds per square inch gauge (about 56 to about 112 kilograms per square centimeter). By "hydrogen partial pressure" we mean the total pressure in the reactor multiplied by the mol fraction of hydrogen in the gas feed. When the sole gas in the reaction system is hydrogen, then the hydrogen partial pressure and total pressure will be the same. The hydrogen ratio must be at least about 0.5, preferably in the range of about 1.0 to about 3.0. By "hydrogen ratio" we mean the ratio of hydrogen in the gas feed to that theoretically required for substantially complete conversion of all of the carbon in the liquid feed to methane. The residence time must be at least three seconds but no more than about 120 seconds, preferably at least about four seconds but no more than about 45 seconds. Although these conditions, as set forth above, are critical in order to maximize the amount of benzene produced, it is understood that best results are obtained by a close correlation of the above parameters, one with the other, then can easily be determined in practice.

By following the above dictates we have found that, per pass, the benzene yield is at least about 45 weight per cent based on the hydrocarbon feed, but in general the benzene yield based on the hydrocarbon feed ranges from about 50 to about 70 weight per cent. Substantially all of the benzene produced is obtained as a result of the conversion of the polynuclear aromatic compounds. The benzene and the remaining individual liquid components can be recovered from the reaction product in any suitable manner, for example, by fractionation, after the gaseous products have been previously removed from the reaction product by reducing the pressure thereon and venting.

DESCRIPTION OF PREFERRED EMBODIMENTS

A number of runs was carried out in which various feeds, together with hydrogen, were passed downwardly through a reactor to obtain a product containing benzene. The reactor was 13⅝ inches (34.6 centimeters) long, ½-inch (1.27 centimeters) inner diameter, had a total volume of 2.51 cubic inches (41.2 cubic centimeters) and contained a ⅛-inch (0.318 centimeter) thermowell down the center. The reactor was packed with −10 to +20 mesh quartz packing and had a void volume of 1.10 cubic inches (18.1 cubic centimeters). The charge stocks used were coal liquids obtained from the hydrogenation of a Big Horn coal, the coal liquids (A), (B) and (C) having a boiling range at atmospheric pressure of 200° to 449° C., 200° to 489° C. and 200° C.+, respectively. Two runs were made with coal liquid (A), one with coal liquid (B) and two with coal liquid (C). The properties of the feedstocks used are set forth below in Table I.

TABLE I

| Gravity, ° API | A | B | C | |
|---|---|---|---|---|
| Elemental Analysis, Weight Per Cent | | | | |
| Carbon | 90.3 | 90.5 | 89.33 | |
| Hydrogen | 7.17 | 8.1 | 8.79 | |
| Oxygen | 1.5 | 0.76 | 1.77 | |
| Nitrogen | 0.56 | 0.48 | 0.63 | |
| Sulfur | 0.14 | 0.10 | 0.23 | |
| Hydrocarbon Analysis, Weight Per Cent | | | | |
| Aromatics | — | 84 | 70 | |
| Saturates | — | 7.2 | 7.6 | |
| Benzene, Weight Per Cent of Aromatic Fraction | — | 0 | 0 | |
| Asphalthenes, Weight Per Cent | 0 | 0 | 8.1 | |
| Carbon Residue, Weight Per Cent | — | — | — | |
| Distillation | | | | |
| 10 Per Cent | 267° C. | 253° C. | 268° C. | |
| 50 Per Cent | 335° C. | 313° C. | 350° C. | |
| 90 Per Cent | 418° C. | 370° C. | 492° C. | Ep. 14.4 Per Cent Residue |
| Boiling Range | 200–449° C. | 200–489° C. | 200° C. + | |
| Hydrogen to Carbon Atomic Ratios | 0.95 | 1.08 | 1.18 | |

It can be seen that there generally was no benzene in the feed stocks. Upon completion of the runs, the reaction product obtained was analyzed and the data obtained are set forth in Table II below.

TABLE II

| Run No. | I | II | III | IV | V |
|---|---|---|---|---|---|
| Coal Liquid Used | A | A | B | C | C |
| Liquid Feed Rate (Grams Per Hour) | 15.7 | 14.8 | 15.3 | 14.8 | 7.4 |
| Gas Feed (100 Per Cent Hydrogen), (Liters Per Hour at STP) | 45 | 45 | 45 | 45 | 22.5 |
| Total Reactor Pressure PSI ($Kg/Cm^2$) | 1500 (105) | 1500 (105) | 1500 (105) | 1500 (105) | 1500 (105) |
| Residence Time, Seconds | 29 | 29 | 29 | 30 | 60 |
| Hydrogen Ratio | 1.2 | 1.2 | 1.3 | 1.4 | 1.4 |
| Average Reactor Temperature, ° C. | 798 | 801 | 794 | 779 | 763 |
| Maximum Temperature Reached, ° C. | 843 | 843 | 843 | 817 | 816 |
| Product Yields, Per Cent By Weight Based on Liquid Feed | | | | | |
| Benzene | 51.3 | 60 | 42.4 | 32.5 | 36.9 |
| Toluene | 0.3 | 0.3 | 0.3 | 1.2 | 0.3 |
| Xylenes and/or Ethylbenzene | 0.2 | 0.2 | 0.1 | 0.6 | 0.1 |
| Naphthalenes | 9.6 | 5.1 | 3.8 | 22.7 | 6.4 |
| Anthracene and/or Phenanthrene | 1.4 | 0.1 | 0.41 | 1.7 | 1.5 |
| Methane | 31.8 | 30.2 | 47.8 | 30.9 | 48.8 |
| Ethane | 3.4 | 3.3 | 4.4 | 6.6 | 4.2 |

The data in Table II above amply demonstrates the criticality of operating within the defined limits herein to obtain a product containing large amounts of benzene. Thus, when the hydrogen to carbon atomic ratio was maintained within the critical ranges defined herein in Runs Nos. I and II, namely 0.95:1, excellent benzene yields were maintained. On the other hand, when the hydrogen to carbon atomic ratio in the feed was outside the critical range in each of Runs Nos. III, IV and IV, reduced benzene yields were obtained.

Obviously, many modifications and variations of the invention, as hereinabove set forth, can be made without departing from the spirit and scope thereof and, therefore, only such limitations should be imposed as are indicated in the appended claims.

We claim:

1. A process for preparing benzene from coal liquids obtained from the hydrogenation of coal boiling above about 200° C. containing at least about 30 weight per cent aromatics, of which at least about 40 weight per cent are polynuclear aromatic compounds, condensed (fused) as well as non-condensed, and whose hydrogen to carbon atomic ratio is in the range of about 0.8:1 to about 1.05:1, which consists essentially in heating such coal liquids, together with hydrogen, in a noncatalytic bed at least to a temperature of about 700° C. while maintaining an average reaction temperature of about 650° to about 1100° C., a total pressure of about 800 to about 2500 pounds per square inch gauge, a hydrogen partial pressure of about 500 to about 2000 pounds per square inch gauge, with the hydrogen ratio being at least about 0.50 and a residence time of three to about 120 seconds, and thereafter recovering benzene from the reaction product.

2. The process of claim 1 wherein the hydrogen to carbon atomic ratio of the feed is in the range of about 0.85:1 to about 1:1, said first-named temperature is above about 760° C., the average reactor temperature is about 700° to about 930° C., the total pressure is in the range of about 900 to about 2000 pounds per square inch gauge, the hydrogen partial pressure is about 800 to about 1600 pounds per square inch gauge, the hydrogen ratio is about 1.0 to about 3.0 and the residence time about four to about 45 seconds.

* * * * *

UNITED STATES PATENT AND TRADEMARK OFFICE

Certificate

Patent No. 4,090,942 Patented May 23, 1978

Harold Beuther and Angelo A. Montagna

Application having been made by Harold Beuther and Angelo A. Montagna, the inventors named in the patent above identified, and Gulf Research & Development Company, Pittsburgh, Pennsylvania, a corp. of Delaware, the assignee, for the issuance of a certificate under the provisions of Title 35, Section 256, of the United States Code, adding the names of Herman N. Woebcke, Joseph J. Williams and Paul E. Koppel as joint inventors, and a showing and proof of facts satisfying the requirements of the said section having been submitted, it is this 29th day of April 1980, certified that the names of the said Herman N. Woebcke, Joseph J. Williams and Paul E. Koppel are hereby added to the said patent as joint inventors with the said Harold Beuther and Angelo A. Montagna.

FRED W. SHERLING,
*Associate Solicitor.*